US006056569A

United States Patent [19]

Nakamura

[11] Patent Number: 6,056,569

[45] Date of Patent: May 2, 2000

[54] JOINT CONNECTOR AND A METHOD OF FORMING A JOINT CIRCUIT IN THE JOINT CONNECTOR

[75] Inventor: Mitsuharu Nakamura, Shizuoka, Japan

[73] Assignee: Yazaki Corporation, Tokyo, Japan

[21] Appl. No.: 09/231,072

[22] Filed: Jan. 14, 1999

[30] Foreign Application Priority Data

Jan. 20, 1998 [JP] Japan ..... 10-008980

[51] Int. Cl.[7] ..... H01R 29/00

[52] U.S. Cl. ..... 439/189; 439/402; 439/516

[58] Field of Search ..... 439/596, 189, 439/397, 402, 516

[56] References Cited

U.S. PATENT DOCUMENTS

| | | | |
|---|---|---|---|
| 3,890,029 | 6/1975 | Izraeli | 439/397 |
| 4,040,703 | 8/1977 | Shaffer et al. | 439/402 |
| 5,676,564 | 10/1997 | Kobayashi et al. | 439/509 |
| 5,690,505 | 11/1997 | Hirata | 439/402 |
| 5,888,103 | 3/1999 | Norizuki et al. | 439/701 |

FOREIGN PATENT DOCUMENTS

| | | | |
|---|---|---|---|
| 63-308884 | 12/1988 | Japan | H01R 31/02 |
| 9-22745 | 1/1997 | Japan | H01R 4/24 |

*Primary Examiner*—Lincoln Donovan
*Assistant Examiner*—Hae Moon Hyeon
*Attorney, Agent, or Firm*—Sughrue, Mion, Zinn Macpeak & Seas, PLLC

[57] ABSTRACT

A joint connector includes a connector housing (11), which has a plurality of wire receiving chambers (12), and a plurality of openings (13) formed respectively in those portions of the connector housing opposed respectively to those portions of wires (20) (which are received respectively in the wire receiving chambers (12)) to be joined together, a cover (15) mounted through hinges (14*a*) on the connector housing (11) so as to open and close the openings (13), and a plurality of press-connecting joint terminals (19) which are provided on that portion of the cover (15) which can be opposed to the joint portions of the wires (20), and join a predetermined number of wires (20) together when the openings (13) are closed by the cover (15). The cover (15) comprises a first cover (16), and a second cover (17), and the plurality of press-connecting joint terminals (19), interconnected by a severable, electrically-conductive connecting portion (19), are integrally molded in the second cover (17).

7 Claims, 4 Drawing Sheets

JOINT CONNECTOR AND A METHOD OF FORMING A JOINT CIRCUIT IN THE JOINT CONNECTOR

BACKGROUND OF THE INVENTION

1. Field of the Invention

The present invention relates to a joint connector for joining a plurality of wires, for example, of a wire harness in an automobile together, and also relates to a method of forming a joint circuit in the joint connector.

The present application is based on Japanese Patent Application No. Hei. 10-8980, which is incorporated herein by reference.

2. Description of the Related Art

FIGS. 4 and 5 show a joint connector disclosed in Unexamined Japanese Patent Publication No. Sho. 63-308884. This joint connector (branch connector) 1 comprises a connector housing 2 made of a synthetic resin, and a plurality of press-connecting joint terminals 3. The connector housing 2 has a plurality of wire receiving chambers 2*a,* serving also as terminal receiving chambers, and a plurality of rectangular openings 2*b* are formed respectively in those portions of the connector housing 2 opposed respectively to those portions of wires 4 (received respectively in the wire receiving chambers 2*a*) to be joined together. The plurality of press-connecting joint terminals 3 are inserted into the respective openings 2*b* so that each joint terminal 3 can join a predetermined number of the associated wires 4, received in the respective wire receiving chambers 2*a,* together. The plurality of press-connecting joint terminals 3 are prepared in the form of a chain having a plurality of pairs of press-connecting blades 3*c* and 3*c* which are formed on a base portion 3*a,* and are spaced from one another by slits 3*b,* and by severing the base portion 3*a* at the slits 3*b,* a terminal chain, having a desired number (two, three or other number) of press-connecting joint terminals 3, can be formed.

Male crimp-type terminals 5, connected respectively to front ends of the wires 4, are inserted respectively into the wire receiving chambers 2*a* in the connector housing 2, and then the chain of press-connecting joint terminals 3 are inserted respectively into the openings 2*b* formed through each of the upper and lower walls of the connector housing 2, and the pairs of press-connecting blades 3*c* and 3*c* of the chain of press-connecting joint terminals 3 are press-connected respectively to the front end portions of the wires 4, so that a predetermined joint circuit is formed.

A technique, analogous to this joint connector, is disclosed in Unexamined Japanese Patent Publication No. Hei. 9-22745.

In the above joint connector 1, however, chains of press-connecting joint terminals 3, corresponding to a desired joint circuit pattern, must be beforehand prepared by severing a long terminal chain, and therefore the stock control for the parts before the assembling of the joint connector 1 has been troublesome, so that the cost of the parts has been increased. And besides, after the crimp-type terminals 5 are inserted respectively into the wire receiving chambers 2*a,* the chain of press-connecting joint terminals 3 are inserted respectively into the openings 2*b,* and are press-connected respectively to the wires 4, and therefore much time and labor have been required for the assembling operation.

SUMMARY OF THE INVENTION

With the above problems in view, it is an object of the present invention to provide a joint connector, as well as a method of forming a joint circuit in the joint connector, in which the cost of parts can be reduced, and also the time and labor, required for the assembling operation, can be reduced.

According to the first aspect of the present invention, there is provided a joint connector which comprises: a connector housing including a plurality of wire receiving chambers in which a plurality of wires can be respectively accommodated, and a plurality of openings; a cover pivotably mounted on the connector housing through a hinge so as to open or close the openings, wherein, when the cover opens, joint portions of the wires are exposed through the openings; a plurality of press-connecting joint terminals arranged on the cover; and an electrically-conductive connecting portion electrically connecting at least two of the press-connecting joint terminals to each other, wherein, when the openings are closed by the cover, the press-connecting joint terminals are press-connected to the joint portions of the wires so that at least two of the wires are electrically connected to each other through the press-connecting joint terminals which are electrically connected by the electrically-conductive connecting portion, and wherein, the electrically-conductive connecting portion can be severed so as to be disconnected from at least one of the press-connecting joint terminals. Further, it is preferable that the press-connecting joint terminals are integrally molded in the cover.

In the above-described joint connector, by severing the electrically-conductive connecting portion, any of desired joint circuit patterns is available with one connector housing, and therefore the cost of the parts can be reduced. And besides, merely by closing the cover, the predetermined number of wires can be joined together by the plurality of press-connecting joint terminals, and therefore the time and labor, required for the assembling operation, are reduced.

Further, according to the second aspect of the present invention, it is preferable that the cover comprises a first cover connected to the connector housing through the hinge so as to open or close the openings, and a second cover which is connected to the first cover through a hinge. In this case, it is preferable that the joint connector further comprises a cover receiving portion formed in the first cover, wherein the second cover can be received in the cover receiving portion, and the press-connecting joint terminals are integrally molded in the second cover. In this joint connector, the severed portion of the connecting portion in the second cover is covered with the first cover, and therefore the press-connecting joint terminals are prevented from exposure, and this enhances the appearance of the joint connector in the closed condition of the cover. And besides, since the press-connecting joint terminals are thus prevented from exposure, the short-circuiting with other circuit is prevented. Furthermore, according to the third aspect of the present invention, it is preferable that the first cover has an engagement portion with which a retaining portion of the connector housing and a retaining portion of the second cover can be releasably engaged. In this joint connector, the engagement portion of the first cover is retainingly engaged with the retaining portion of the connector housing, with the second cover retainingly engaged with the engagement portion of the first cover. Therefore, the press-connecting joint terminals can be easily and positively press-connected respectively to the wires, and also this connected condition is positively maintained.

Furthermore, according to the fourth aspect of the present invention, there is provided a method of forming a desired circuit in a joint connector which comprises a connector housing including a plurality of wire receiving chambers in which a plurality of wires can be respectively accommodated, and a plurality of openings; a cover pivotably mounted on the connector housing through a hinge so as to open or close the openings, wherein, when the cover opens, joint portions of the wires are exposed through the openings; a plurality of press-connecting joint terminals arranged on the cover; and an electrically-conductive connecting portion electrically connecting at least two of the press-connecting joint terminals to each other, wherein, when the openings are closed by the cover, the press-connecting joint terminals are press-connected to the joint portions of the wires, the method comprising a step of severing the electrically-conductive connecting portion when the cover is opened, to thereby disconnect from at least one of the press-connecting joint terminals, wherein, when the openings are closed by the cover, at least two of the wires are electrically connected to each other through the press-connecting joint terminals which are electrically connected by the electrically-conductive connecting portion. In this method of forming the desired circuit in the joint connector, by severing the connecting portion, the joint pattern, corresponding to the predetermined circuit, is formed, and therefore the joint circuit, best suited for the joint connector, can be formed in a short time with the simple operation.

DETAILED DESCRIPTION OF THE PREFERRED EMBODIMENT

One preferred embodiment of the present invention will now be described with reference to FIGS. 1A to 3C.

Figure 1A:
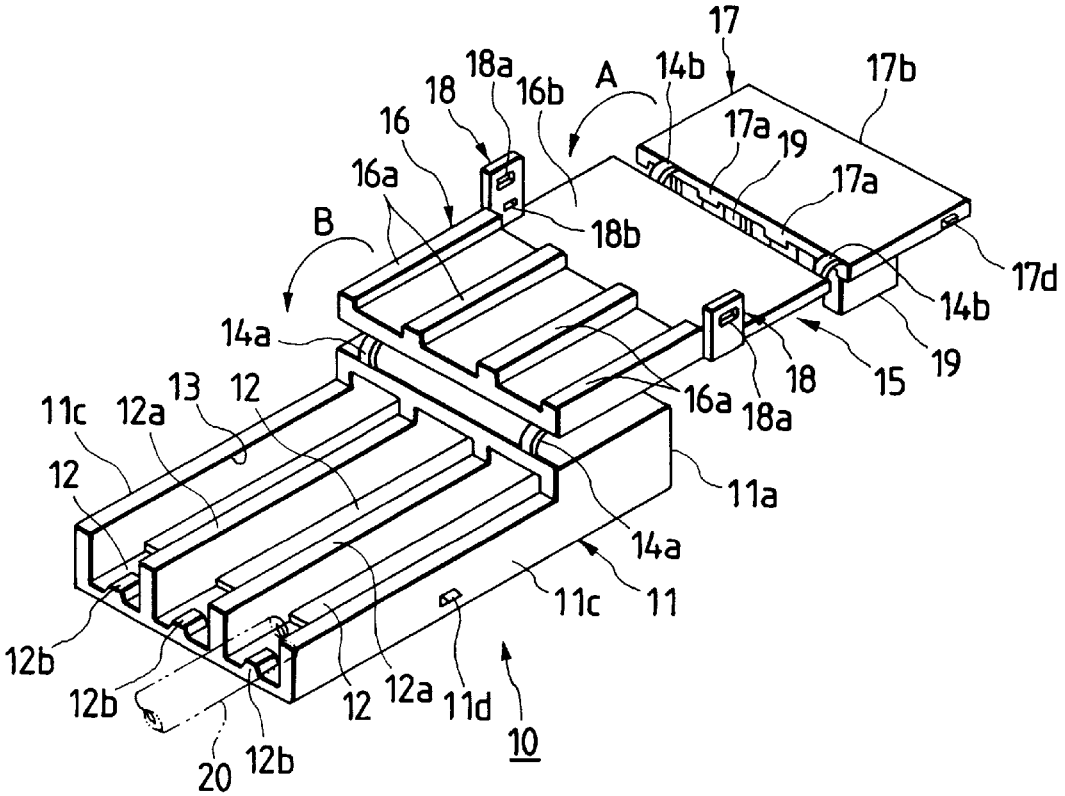
FIG. 1A is a perspective view of one preferred embodiment of a joint connector of the present invention, showing a condition before a cover of the joint connector is closed.
Figure 1B:
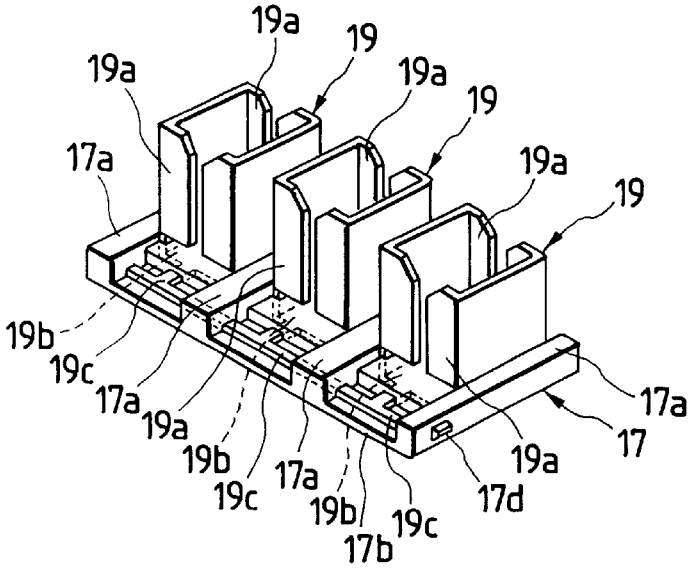
FIG. 1B is an enlarged, perspective view of an important portion of the cover.
Figure 2:
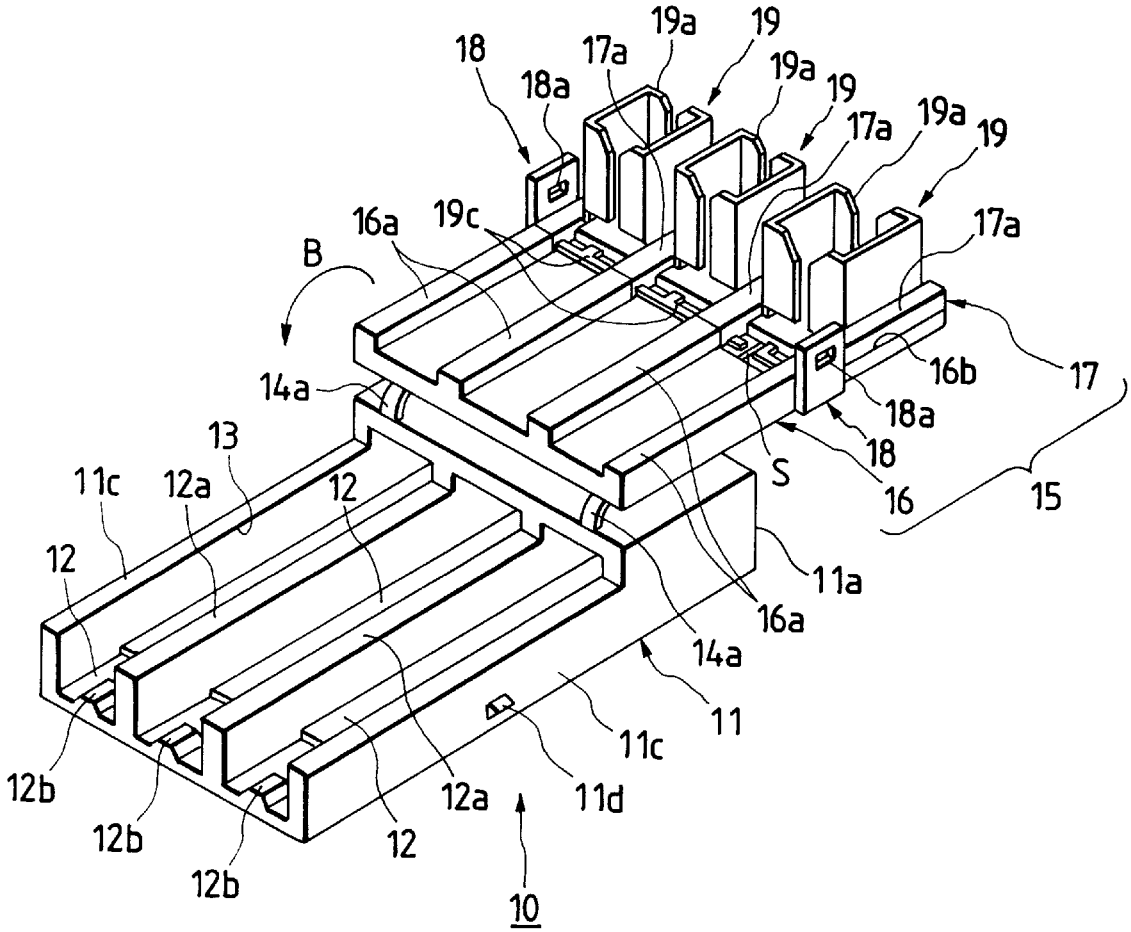
FIG. 2 is a perspective view showing a condition in which a second cover of the cover of the joint connector is closed.

As shown in FIGS. 1A, 1B and 2, the joint connector 10 comprises a connector housing 11 which has a plurality of wire receiving chambers 12, serving also as terminal receiving chambers, and a plurality of openings 13 formed respectively in those portions of the connector housing 11 opposed respectively to those portions of wires 4 (which are received respectively in the wire receiving chambers 12) to be joined together. The joint connector 10 further comprises the cover 15 of a synthetic resin mounted through a pair of hinges 14*a* and 14*a* on the connector housing 11 so as to open and close the openings 13 in the connector housing 11, and the plurality of press-connecting joint terminals 19 which are provided on that portion of the cover 15 which can be opposed to the joint portions of the wires 20, and join a predetermined number of wires 20 together when the openings 13 are closed by the cover 15.

As shown in FIGS. 1A to 3C, the wire receiving chambers 12 in the connector housing 11 are separated from one another in a widthwise direction by partition walls 12*a,* and a projection (projected portion) 12*b* for preventing the displacement of the wire 20 is formed on an end portion of a bottom wall of each wire receiving chamber 12. That portion of the connector housing 11, forming front end portions of the wire receiving chambers 12, has a box-shape, and terminal insertion holes 11*b* for respectively passing male terminals of a mating connector (not shown) therethrough are formed respectively through those portions of a front wall 11*a* of this box-shaped portion opposed respectively to contact portions 21*a* of female crimp-type terminals 21 connected respectively to front ends of the wires 20 received respectively in the wire receiving chambers 12. A retaining projection (retaining portion) lid is formed at a central portion of each of opposite side walls 11*c* and 11*c* of the connector housing 11 having the same height as that of the partition walls 12*a*.

As shown in FIGS. 1A, 1B and 2, the cover 15 comprises the first cover 16, integrally formed with the connector housing 11 through the pair of hinges 14*a* and 14*a* so as to open and close the openings 13 in the connector housing 11, and the second cover 17 which is integrally formed with the first cover 16 through a pair of hinges 14*b* and 14*b,* and can be received in the cover receiving portion 16*b* formed in the first cover 16. The plurality of press-connecting joint terminals 19, interconnected by the severable, electrically-conductive connecting portion 19*c,* are integrally molded in the second cover 17 by insert molding.

As shown in FIGS. 1A and 2, the first cover 16 of a rectangular shape can close the openings 13 in the connector housing 11, and ribs 16*a* for abutting respectively against the side walls 11*c* and the partition walls 12*a* of the connector housing 11 are formed integrally on a front half of that side (surface) of the first cover 16 to be opposed to the openings 13. The cover receiving portion 16*b* for receiving the second cover 17 is formed in a rear half of that side of the first cover 16 to be opposed to the openings 13. A rectangular engagement piece portion (engagement portion) 18 is formed at a central portion of each of opposite side edge portions of the first cover 16, and the retaining projections (retaining portions) 11*d* of the connector housing 11, as well as retaining projections (retaining portions) 17*d* formed respectively on opposite side edges of the second cover 17 at a front end portion thereof, can be releasably engaged respectively in the engagement piece portions 18. More specifically, each retaining projection 11*d* of the connector housing 11 can be releasably engaged in an engagement holes 18*a* formed in an upper portion of the associated engagement piece portion 18, and each retaining projection 17*d* of the second cover 17 can be releasably engaged in an engagement recess 18*b* which is formed in the associated engagement piece portion 18, and is disposed beneath the engagement hole 18*a*.

As shown in FIGS. 1A, 1B and 2, the second cover 17 has such a rectangular plate-like configuration as to be received in the cover receiving portion 16*b* of the first cover 16, and that side (surface) of the second cover 17 for abutment against the cover receiving portion 16*b* is flat. Ribs 17*a* for abutting respectively against the side walls 11*c* and the partition walls 12*c* of the connector housing 11 are formed integrally on that side (surface) of the second cover 17 to be opposed to the openings 13 in the connector housing 11. A connecting plate portion 19*b,* interconnecting a pair of press-connecting blades 19*a* and 19*a* of each press-connecting joint terminal 19, is integrally molded by insert molding in that portion of the second cover 17 lying between any two adjacent ribs 17*a.* The severable, electrically-conductive connecting portion 19*c,* formed integrally with the connecting plate portions 19*b* of the press-connecting joint terminals 19, is integrally molded by insert molding in the ribs 17*a* of the second cover 17. That portion of the connecting portion 19*c,* lying between any two adjacent ribs 17*a* of the second cover 17, is exposed to the exterior, and is adapted to be severed, together with a bottom wall 17*b* of the second cover 17, by a pair of cutting blades H and H of an automatic machine.

As shown in FIGS. 1B and 2, each press-connecting joint terminal 19 comprises the pair of front and rear press-connecting blades 19*a* and 19*a* to be press-connected to the wire 20 received in the wire receiving chamber 12 in the connector housing 11, the connecting plate portion 19*b* of a generally U-shape formed by bending the press-connecting blades 19*a,* and the connecting portion 19*c* which projects from a central portion of a bottom wall of the connecting plate portion 19*b,* and is formed integrally with a bottom wall of the connecting plate portion 19*b* of the adjacent press-connecting joint terminal 19.

Figure 3A:
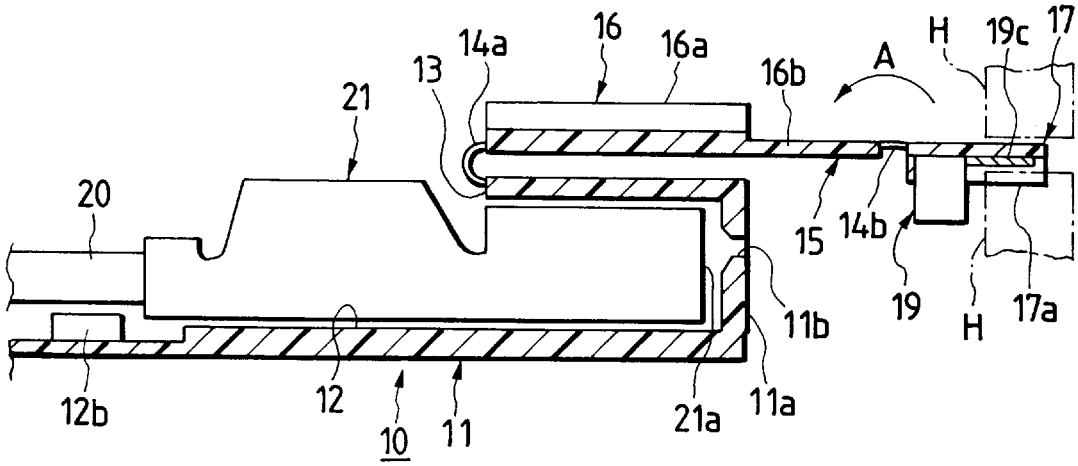
FIG. 3A is a cross-sectional view showing a condition in which a connecting portion, interconnecting a plurality of press-connecting joint terminals integrally molded in the second cover, is severed.

A procedure of assembling the joint connector 10 of the above embodiment will now be described. First, as shown in FIG. 3A, the crimp-type terminals 21, connected respectively to the wires 20, are inserted respectively into the wire receiving chambers 12 (also serving as the terminal receiving chambers) in the connector housing 11, and then the connecting portion 19*c,* interconnecting the plurality of press-connecting joint terminals 19, is severed at a predetermined portion thereof by the pair of cutting blades H and H of the automatic machine in accordance with a joint pattern (joint circuit). Then, the second cover 17 is closed (as indicated by arrow A in FIGS. 1A and 3A) to be received in the cover receiving portion 16*b* of the first cover 16. At this time, the retaining projections 17*d* of the second cover 17 are retainingly engaged respectively in the engagement recesses 18*b* formed respectively in the engagement piece portions 18 of the first cover 16, so that the second cover 17 is positively received in the cover receiving portion 16*b* of the first cover 16 without shaking. And besides, by severing the predetermined portion of the connecting portion 19*c* by the automatic machine, the joint pattern, corresponding to the predetermined circuit, can be formed, and the joint circuit, best suited for the joint connector 10, can be formed in a short time with the simple operation.

Figure 3B:
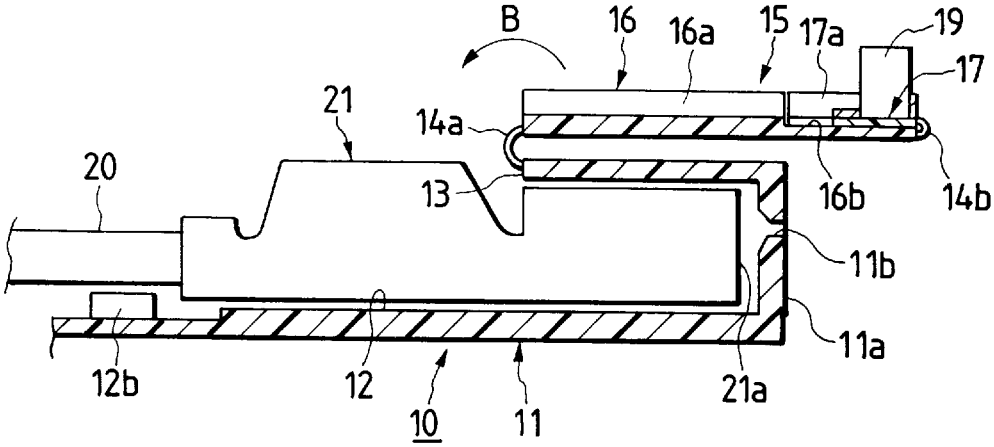
FIG. 3B is a cross-sectional view showing a condition in which the second cover is received in a cover receiving portion of a first cover.
Figure 3C:
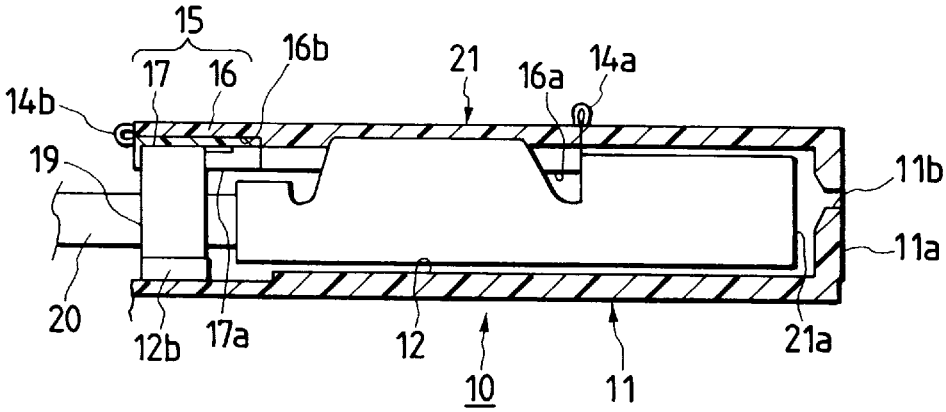
FIG. 3C is a cross-sectional view showing a condition in which openings in the joint connector are closed by the first cover, and wires are joined together by the plurality of press-connecting joint terminals in the second cover.
Figure 4:
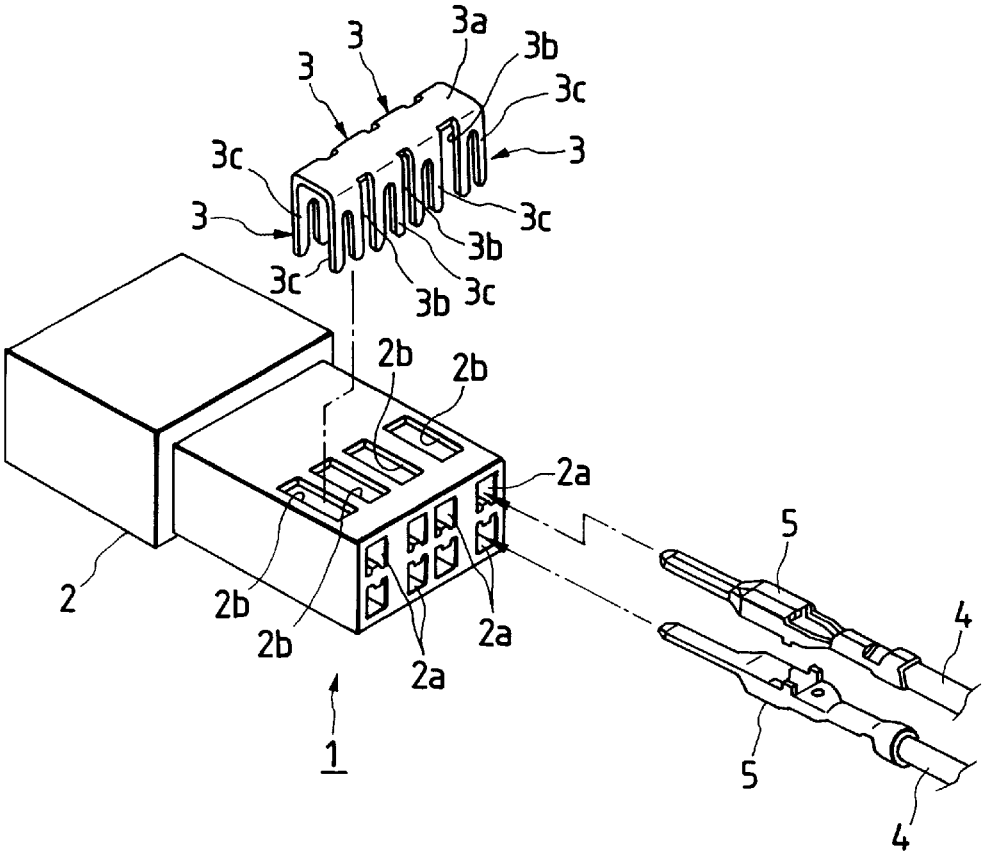
FIG. 4 PRIOR ART
FIG. 4 is an exploded, perspective view of a joint connector according to the related art.
Figure 5:
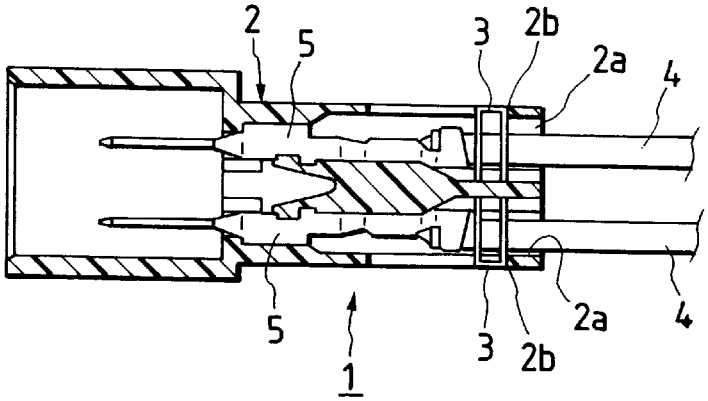
FIG. 5 PRIOR ART
FIG. 5 is a cross-sectional view of the joint connector according to the related art.

Then, when the openings 13 in the connector housing 11 are closed by the first cover 16 as indicated by arrow B in FIGS. 2 and 3B by the use of the automatic machine, the press-connecting joint terminals 19 are press-connected respectively to the wires 20 as shown in FIG. 3C, so that a predetermined number of wires 20 are joined together. At this time, the projection 12*b,* projecting from the bottom wall of each wire receiving chamber 12 in the connector housing 11, prevents the displacement of the wire 20 so that the pair of press-connecting blades 19*a* and 19*a* of the press-connecting joint terminal 19 can be easily press-connected to the wire 20. This connected condition is positively maintained by the retaining engagement of each retaining projection lid of the connector housing 11 in the engagement hole 18*a* in the associated engagement piece portion 18 of the first cover 16.

Thus, the predetermined portion of the connecting portion 19*c,* interconnecting the plurality of press-connecting joint terminals 19, is severed by the pair of cutting blades H and H of the automatic machine, and by doing so, any of the desired joint circuit patterns is available with one connector housing 11, and therefore the cost of the parts can be reduced. When the first cover 16 is closed by cover closing means (not shown) of the automatic machine, the press-connecting terminals 19 are press-connected respectively to the wires 20, so that the predetermined number of wires 20 are joined together, and therefore the time and labor, required for the assembling operation, can be greatly reduced. In this case, a severed portion (designated at S in FIG. 2) in the connecting portion 19*c* in the second cover 17 is positively covered with the cover receiving portion 16*b* of the first cover 16, and therefore the press-connecting joint terminals 19 are prevented from exposure, and this enhances the appearance of the joint connector in the closed condition of the first cover 16. Since the press-connecting joint terminals 19 are thus prevented from exposure, the short-circuiting with other circuit is prevented. And besides, the engagement hole 18*a* in each engagement piece portion 18 of the first cover 16 can be retainingly engaged with the associated retaining projection lid of the connector housing 11, with each retaining projection 17*d* of the second cover 17 retainingly engaged in the engagement recess 18*b* of the associated engagement piece portion 18 of the first cover 16, and therefore the press-connecting terminals 19 can be easily and positively press-connected respectively to the wires 20, and the joint connector 10 of high precision can be provided at low costs.

In the above embodiment, although the plurality of wires of a wire harness, used in an automobile, are joined together, the above embodiment can, of course, be applied to the case where a plurality of wires in other construction than the wire harness are joined together.

As described above, in the present invention of claim 1, by severing the connecting portion interconnecting the plurality of press-connecting joint terminals, any of the desired joint circuit patterns is available with one connector housing, and therefore the cost of the parts can be reduced. And besides, merely by closing the cover, the predetermined number of wires can be joined together by the plurality of press-connecting joint terminals, and therefore the time and labor, required for the assembling operation, are reduced.

In the present invention of claim 2, the severed portion of the connecting portion in the second cover is covered with the first cover, and therefore the press-connecting joint terminals are prevented from exposure, and this enhances the appearance of the joint connector in the closed condition of the cover. And besides, since the press-connecting joint terminals are thus prevented from exposure, the short-circuiting with other circuit is prevented.

In the present invention of claim 3, the engagement portion of the first cover is retainingly engaged with the retaining portion of the connector housing, with the second cover retainingly engaged with the engagement portion of the first cover. Therefore, the press-connecting joint terminals can be easily and positively press-connected respectively to the wires, and also this connected condition is positively maintained.

In the present invention of claim 4, by severing the connecting portion, the joint pattern, corresponding to the predetermined circuit, is formed, and therefore the joint circuit, best suited for the joint connector, can be formed in a short time with the simple operation.

What is claimed is:

1. A joint connector, comprising:

a connector housing including a plurality of wire receiving chambers in which a plurality of wires can be respectively accommodated, and a plurality of openings;

a cover pivotably mounted on the connector housing through a hinge so as to open or close the openings, wherein, when the cover opens, joint portions of the wires are exposed through the openings;

a plurality of press-connecting joint terminals arranged on the cover; and an electrically-conductive connecting portion electrically connecting at least two of the press-connecting joint terminals to each other, wherein, when the openings are closed by the cover, the press-connecting joint terminals are press-connected to the joint portions of the wires so that at least two of the wires are electrically connected to each other through the press-connecting joint terminals which are electrically connected by the electrically-conductive connecting portion, and wherein, the electrically-conductive connecting portion can be severed so as to be disconnected from at least one of the press-connecting joint terminals.

2. The joint connector of claim 1, wherein the press-connecting joint terminals are integrally molded in the cover.

3. The joint connector of claim 1, wherein the cover comprises a first cover connected to the connector housing through the hinge so as to open or close the openings, and a second cover which is connected to the first cover through a hinge.

4. The joint connector of claim 3, further comprising a cover receiving portion formed in the first cover, wherein the second cover can be received in the cover receiving portion, and the press-connecting joint terminals are integrally molded in the second cover.

5. The joint connector of claim 3, wherein the first cover has an engagement portion with which a retaining portion of the connector housing and a retaining portion of the second cover can be releasably engaged.

6. The joint connector of claim 4, wherein the first cover has an engagement portion with which a retaining portion of the connector housing and a retaining portion of the second cover can be releasably engaged.

7. A method of forming a desired circuit in a joint connector which comprises a connector housing including a plurality of wire receiving chambers in which a plurality of wires can be respectively accommodated, and a plurality of openings; a cover pivotably mounted on the connector housing through a hinge so as to open or close the openings, wherein, when the cover opens, joint portions of the wires are exposed through the openings; a plurality of press-connecting joint terminals arranged on the cover; and an electrically-conductive connecting portion electrically connecting at least two of the press-connecting joint terminals to each other, wherein, when the openings are closed by the cover, the press-connecting joint terminals are press-connected to the joint portions of the wires, the method comprising a step of severing the electrically-conductive connecting portion when the cover is opened, to thereby disconnect from at least one of the press-connecting joint terminals, wherein, when the openings are closed by the cover, at least two of the wires are electrically connected to each other through the press-connecting joint terminals which are electrically connected by the electrically-conductive connecting portion.

* * * * *